US005946816A

United States Patent [19]

Smith

[11] Patent Number: 5,946,816

[45] Date of Patent: Sep. 7, 1999

[54] CONTINUOUS MICROWAVE REGENERATION APPARATUS FOR ABSORPTION MEDIA

[75] Inventor: Douglas D. Smith, Knoxville, Tenn.

[73] Assignee: Lockheed Martin Energy Systems, Inc., Oak Ridge, Tenn.

[21] Appl. No.: 09/036,935

[22] Filed: Mar. 9, 1998

[51] Int. Cl.[6] ..... F26B 3/34

[52] U.S. Cl. ..... 34/265; 34/216

[58] Field of Search ..... 34/259, 263, 264, 34/265, 68, 203, 215, 216; 219/775, 772, 779, 780; 432/103, 106

[56] References Cited

U.S. PATENT DOCUMENTS

| | | | |
|---|---|---|---|
| 4,003,554 | 1/1977 | Chauffoureaux | 259/4 |
| 4,055,001 | 10/1977 | Forster et al. | 34/1 |
| 4,087,921 | 5/1978 | Blok | 34/1 |
| 4,126,945 | 11/1978 | Manser et al. | 34/4 |
| 4,129,768 | 12/1978 | Anderson | 219/10.55 |
| 4,173,608 | 11/1979 | Soulier | 264/26 |
| 4,179,595 | 12/1979 | Chiron | 219/10.55 |
| 4,189,629 | 2/1980 | Krage | 219/10.55 |
| 4,320,253 | 3/1982 | Fisher | 174/138 |
| 4,388,511 | 6/1983 | Sander et al. | 219/10.55 |
| 4,622,448 | 11/1986 | Awata et al. | 219/10.55 |
| 4,684,776 | 8/1987 | Heard | 219/10.55 |
| 4,835,354 | 5/1989 | Collins et al. | 219/10.55 |
| 4,968,865 | 11/1990 | Seaborne et al. | 219/10.55 |
| 5,105,555 | 4/1992 | Nakagomi | 34/1 |
| 5,183,787 | 2/1993 | Seaborne | 501/143 |
| 5,360,959 | 11/1994 | Takano et al. | 219/110 |
| 5,420,404 | 5/1995 | Goodman et al. | 219/775 |
| 5,509,956 | 4/1996 | Opperman et al. | 95/109 |
| 5,521,360 | 5/1996 | Johnson et al. | 219/709 |
| 5,675,909 | 10/1997 | Pare | 34/265 |
| 5,822,879 | 10/1998 | Vincent et al. | 34/265 X |

*Primary Examiner*—Henry Bennett
*Assistant Examiner*—Steve Gravini
*Attorney, Agent, or Firm*—Quarles & Brady LLP

[57] ABSTRACT

A method and apparatus for continuously drying and regenerating ceramic beads for use in process gas moisture drying operations such as glove boxes. A microwave energy source is coupled to a process chamber to internally heat the ceramic beads and vaporize moisture contained therein. In a preferred embodiment, the moisture laden ceramic beads are conveyed toward the microwave source by a screw mechanism. The regenerated beads flow down outside of the screw mechanism and are available to absorb additional moisture.

18 Claims, 3 Drawing Sheets

CONTINUOUS MICROWAVE REGENERATION APPARATUS FOR ABSORPTION MEDIA

STATEMENT REGARDING FEDERALLY SPONSORED RESEARCH

This invention was made with government support under contracts DE-AC05-840R21400, awarded by the United States Department of Energy to Lockheed Martin Energy Systems, Inc., and the United States Government has certain rights in this invention.

CROSS REFERENCES TO RELATED APPLICATIONS

Not Applicable

BACKGROUND OF THE INVENTION

The field of invention is moisture absorption media regeneration, more particularly continuous regeneration of moisture absorbing ceramic materials using microwave energy.

Dry gas is necessary in many scientific and commercial applications, such as glove boxes where moisture or other gaseous state contaminant must be removed from a recirculating gas. Commonly, the recirculating gas is exposed to an absorption media that has a tendency to absorb the contaminant. The absorption material absorbs contaminants, such as water, present in the gas. The gas having a lowered contaminant level is then recirculated back to the glove box or other process. After a period of use, the absorption material reaches its maximum absorption level and ceases to efficiently absorb additional contaminants. The material must then be replaced or regenerated to continue cleansing the recirculating gas.

Molecular sieve materials, such as calcium aluminum silicates and similar zeolites, in small bead form having pore sizes of 3 to 13 angstroms, are used as moisture and gas scrubbers to maintain low levels of moisture in recirculating gas streams. These materials are very efficient when dry and can remove moisture down to the low part per million levels in flowing gas streams.

In a typical prior art application, moist recirculating gas is routed through a box containing moisture sieve beads. After the beads have taken up their full load of moisture, they are regenerated by heating to 250° C.–300° C. for several hours to drive off the absorbed moisture and gases. In a continuous process, this regeneration period is disruptive requiring that the process be shut down while the beads are being heated.

A prior art alternative to shutting down the entire process for a period of hours was developed using a two box method. In a two box method, the recirculating gas is rerouted to a second box containing absorption media while the first box is undergoing regeneration. This solution significantly reduces the down time for the continuous process.

The down time in a two box method, however, is not eliminated and other disadvantages remained. Determining when the beads are saturated or inefficient requires a humidity measurement in the gas stream and operational delays caused by switching from the moisture saturated bead bed to a regenerated bed continue to cause problems. In addition, regeneration in the prior art is typically performed by heating the absorption media by electrical resistance heaters which depend on thermal heat transfer by slow conduction and convection heat transfer modes.

In one apparatus for regenerating an absorption media, as disclosed in U.S. Pat. No. 5,509,956, Opperman et al., microwave energy is used to regenerate contaminant absorbing beads. In this apparatus, contaminated gas enters a container containing a polymeric absorption media, the media absorbs the contaminants, and then the decontaminated gas exits the container. When the media reaches a predetermined saturation level, the gas inlet and outlet are closed off, stopping the cleansing process, microwave energy is then directed into a hollow guide tube that distributes the energy throughout the entire container causing the absorption media to release the absorbed contaminants. The contaminants are then siphoned out of the container through a suction port. The application of microwave energy to a drying or decontaminant apparatus shortens the regeneration time. As in other prior art, however, the apparatus disclosed in U.S. Pat. No. 5,509,956 requires a regeneration period that disrupts a continuous flow process.

Certain ceramic compounds have desirable absorption characteristics. Ceramics, in general, however, are difficult to heat by means of microwave energy due to small dielectric loss factors as disclosed in U.S. Pat. No. 4,771,153, Fukushima et al. The ceramic compositions typically used in heating applications, as disclosed in U.S. Pat. No. 4,320,253, Fisher, are ferrite based. Ferrite based ceramics do not appreciably increase in temperature when subjected to microwave heating. As a result, the use of microwave energy to heat ceramic compositions for drying gas purposes and other uses is not known.

BRIEF SUMMARY OF THE INVENTION

A method and apparatus for continuously regenerating absorption media using microwave energy and an absorption media of ceramic beads is disclosed. Hygroscopic ceramic beads absorb moisture when exposed to wet gas introduced into the apparatus. The beads are transported into the presence of microwave energy which heats the beads and moisture vaporizing the moisture. The dried gas and moisture are separately extracted from the apparatus and the ceramic beads are reintroduced to the source of wet gas for reuse.

A feed screw continuously exposes moisture laden beads to a heat source vaporizing the moisture. The regenerated beads then return to the source of wet gas once again to absorb moisture and repeat the process. This accomplishes the general objective of providing an apparatus that can continuously removes contaminants from a recirculating gas.

Another objective is to provide a continuous absorption media regenerating apparatus that quickly regenerates the absorption material. This is accomplished by exposing the saturated absorption media to microwave energy. The microwave energy quickly heats the beads to temperature that causes the release of absorbed contaminants from the media.

It is yet another objective to provide a continuous absorption media regenerating apparatus that regenerates a ceramic absorption media. This is accomplished by employing a microwave heatable ceramic absorption media.

Yet another objective is to provide a continuous absorption media regenerating apparatus that is compact and efficient. This is accomplished by mounting a heat radiator to the exterior of the apparatus. The heat radiator draws heat away from the regenerated beads reducing their temperature for moisture absorption, thus increasing their efficiency. Fewer efficient beads are necessary to accomplish the same results as less efficient beads, thus providing a more compact apparatus.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DETAILED DESCRIPTION OF THE PREFERRED EMBODIMENTS

An apparatus and method is herein described that continuously dries a flowing gas using microwave energy to heat ceramic beads to extract moisture. It must be understood, however, that the apparatus and method described herein may be used to continuously extract components or contaminants other than moisture from a gas by substituting an appropriate microwave heatable absorption media for the ceramic beads. Contaminants shall be defined as to include moisture, components, or any substance that is intended to be absorbed by the absorption media.

Figure 1:
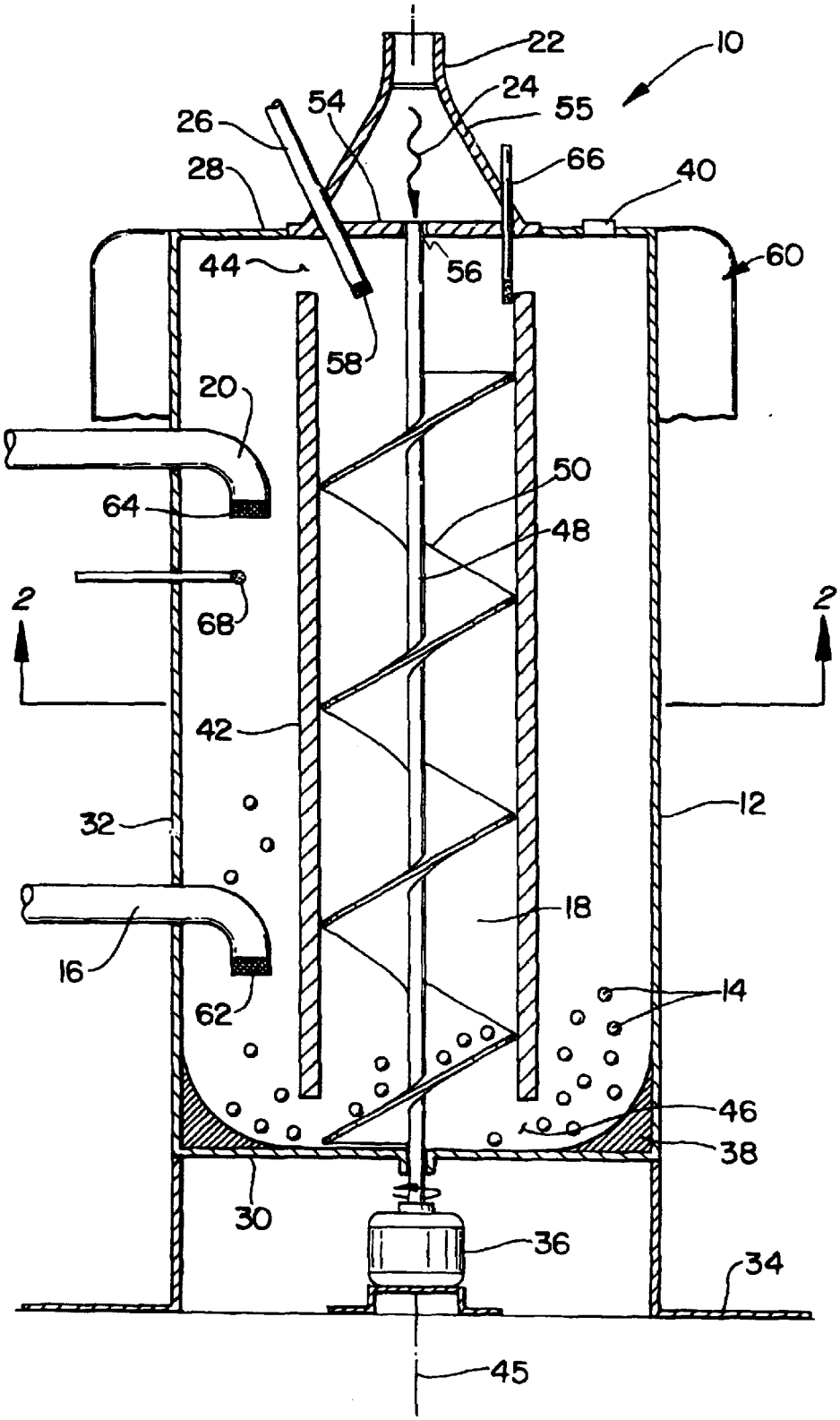
FIG. 1 is a side section view of the gas drying apparatus of a gas drying apparatus incorporating the present invention.

Referring to FIG. 1, a gas drying apparatus 10 has a container 12 containing an absorption media 14, such as hygroscopic ceramic beads, that absorb moisture from a wet gas that enters the absorption portion of the apparatus 10 at the lower portion of the container 12 through a wet gas source 16. The absorption media (alternatively referred to as beads) 14 absorbs the moisture from the gas and is transported to the top of the container 12 by a vertical transporting mechanism 18 through a processing shaft 42. A dry gas outlet 20 extracts the dry gas from the container 12.

As the beads 14 reach the top of the processing shaft 42, a microwave energy source 22 heats the beads 14 and moisture causing the moisture to vaporize. The moisture is extracted from the container 12 by a suction port 26. The regenerated beads 14 are then allowed to return to the bottom of the container 12 to once again absorb moisture from the entering gas.

Figure 2:
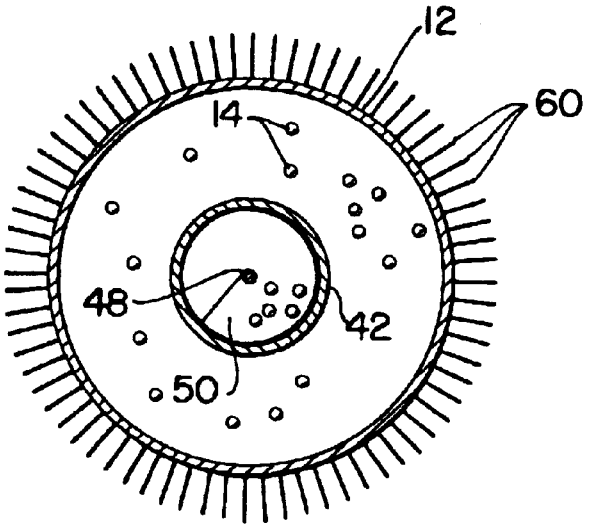
FIG. 2 is top section view of the gas drying apparatus of FIG. 1.

Preferably, as shown in FIGS. 1 and 2, the container 12 is a vertical metal cylinder with a top wall 28, bottom wall 30, and a side wall 32. An exterior bottom support 34 mounted to the bottom wall 30 provides clearance for an electrical motor 36 and stability to the apparatus 10 when in operation. The bottom wall 10 interior has a rounded bottom 38 to direct the beads 14 toward the center of the bottom of the container 12. The rounded bottom feeds beads into a vertical transport mechanism 18. The bottom wall 30 may be former to provide the rounded shape or fillets 38 may be mounted to the interior side of the wall bottom 30 and side 32 to guide the beads toward the transport mechanism 18. A bead fill cap 40 at the top wall 28 provides easy access for adding beads 14.

A cylindrical vertical processing shaft 42 disposed within the container 12 concentrically located about the vertical axis 45 of the cylindrical container 12 provides a path to vertically transport the beads 14 from the absorption portion of the apparatus 10 to the regeneration portion at the top of the shaft 42. The shaft 42 is insulated to prevent heat transfer between the beads 14 moving upwardly toward the top of the shaft 42 and the beads 14 moving downwardly toward the bottom of the container 12. The shaft 42 is cylindrical to facilitate efficient operation of the vertical transport mechanism 18 in the preferred embodiment. Other processing shaft shapes, however, may be used to facilitate efficient operation of other vertical transport mechanisms known in the art.

Figure 3:
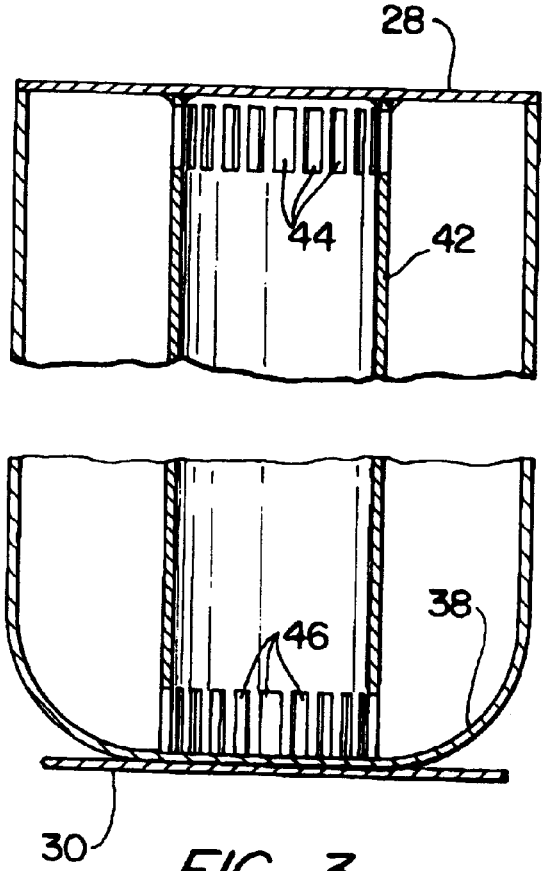
FIG. 3 is a detail view of the processing shaft of the gas drying apparatus of FIG. 1.

As shown in FIG. 3, the top of the shaft 14 is welded to the top wall 28 of the container 12. A plurality of slots 44 at the shaft top provide a path for the beads 14 to spill out of the shaft 42 and return by gravity downwardly to the container bottom 30. The shaft 42 bottom is also welded to the container bottom wall 30 to provide rigidity. The bottom of the shaft 42 has a plurality of slots 46 which allow the beads 14 to enter the shaft 42 for transporting to the top of the shaft 42. A similar attachment means known in the art other than welding may be used to attach the shaft to the top and bottom walls of the container.

Figure 4:
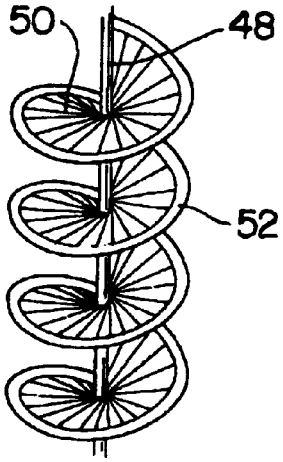
FIG. 4 is a detail view of the feed screw of the gas drying apparatus of FIG. 1.

Preferably, the bead vertical transport mechanism 18 is a feed screw 48 rotatably mounted within the processing shaft 42, as shown in FIGS. 1, 2, and 4. The screw 48 is mounted at the container top wall 28 to a microwave containment plate 54 with a shaft bearing 56. The bottom of the screw 48 is rotatably mounted through the container bottom wall 30 to a continuously adjustable rotational speed electric motor 36. The motor 36 rotatably drives the feed screw 48 transporting beads 14 from the bottom of the container 12 to the top of the shaft 42.

Screw vanes 50 of the feed screw 48 extend to the inner surface of the cylindrical processing shaft 42 and are made of non-energy absorbing material such as glass or composites. As shown in FIG. 4, ribbon shaped microwave energy scattering absorbers 52 are mounted on the vanes 50. The energy scattering absorbers 52 radially disperse energy 24 uniformly in the processing shaft 42 increasing the energy input into the upwardly moving absorption media 14. It must be understood that alternative mechanisms to vertically transport the media 14 may be used, such as, a rotating conveyor belt design.

The absorption media 14 for extracting moisture from the flowing gas is preferably mixed oxide zeolite type ceramic molecular sieve drying beads, such as aluminum calcium silicate zeolites. Small beads 14 having small pore sizes can efficiently remove moisture down to the low parts per million levels in flowing gas streams. Commercially available beads such as Union Carbide Linde 5A or 13A or Davidson Chemical Molecular Sieve may be used. The ceramic mixed oxide zeolites are efficiently coupled by microwave energy and can be heated to their melting temperature. Microwave energy coupling efficiency for these beads is about 48% relative to water at a baseline of 100% coupling. It should be understood that other microwave heatable adsorption media, such as ceramic powders, or plastic beads, and some paste compositions, may be used that absorbs contaminants other than water.

The microwave power generator 22 mounted to the microwave transparent containment plate 54 on the top of the container 12 serves as a microwave energy source. The microwave power generator 22 is preferably a commercial 4.1 gigahertz design using a magnetron, or other oscillator, adjustable in power output from 100 to 1000 watts and capable of quickly heating the ceramic beads 14 to 250°

C.–300° C. The generator 22 is also, preferably, adjustable in transmission mode to satisfy wave guide size and orientation geometries of the processing shaft 42. A horn shaped microwave transmission guide 55 directs the microwave energy 24 toward the upwardly transported ceramic beads 14 inside the processing shaft 42.

A suction port 26 disposed above the beads 14 inside the processing shaft 42 draws vaporized moisture or other contaminants out of the shaft 42 and container 12. A vacuum created by the suction port 26 aids in the moisture extraction. A dust filter 58 mounted over the suction port 26 prevents the induction of extraneous material.

The use of applied "rough" vacuum from the port 26 in the processing shaft and/or high purity flowing cover gas, as from a liquid nitrogen vapor generator, aids in the transport of moisture vapor out of the container for large sizes of installations. Differential gas pressure and weak vacuum off gassing in separate parts of the apparatus 10 can be maintained because of the gas pressure snubbing of the beads 14 when the recirculating gas is being dried.

A finned metal radiator 60 mounted to the exterior of the container side wall 32 draws heat from the regenerated beads 14. Cooling the beads 14 increases moisture absorption efficiency after they have exited the processing shaft 42. Although a passive mechanism to reduce the bead temperature is shown, it should be understood that an active cooling apparatus such as a liquid cooled radiator may be incorporated to aid in bead cooling. By increasing absorption efficiency, fewer beads are necessary resulting in a compact apparatus.

As shown in FIG. 1, a gas source 16 introduces moisture laden gas into the lower, absorption portion of the container 12. The beads 14 draw moisture out of the gas prior to the gas being extracted from the container 12 by a dry gas outlet 20 disposed above the wet gas source 16. Dust filters 62, 64 on the wet gas source 16 and the dry gas outlet 20, respectively, serve to hinder any dust generated by the beads 14 from leaving the container 12 through the gas ports 16, 20.

Figure 5:
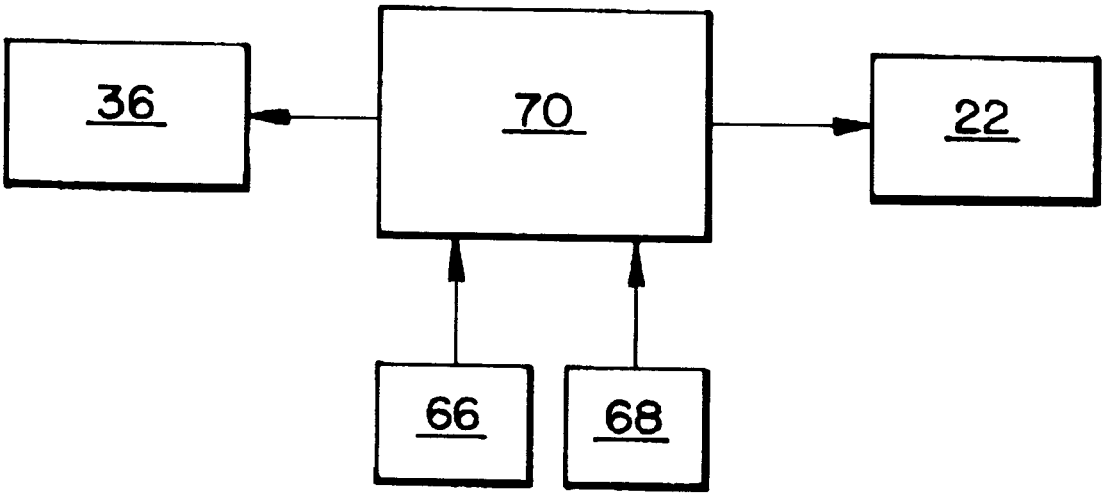
FIG. 5 is a block diagram of the microprocessor control of the apparatus of FIG. 1.

Looking particularly at FIGS. 1 and 5, sensors 66, 68 inside the container 12 provide inputs to a microprocessor 70 that controls the components of the drying apparatus 10. The temperature sensor 66 measures the bead temperature at the top of the processing shaft 42. A humidity sensor 68 disposed below the dry gas outlet 20 measures moisture content of the gas near the dry gas outlet 20. The rotational speed of the motor 36 driving the feed screw 48 may be decreased or increased by the processor 70 depending upon the bead temperature and gas moisture content to ensure the gas is meeting a set parameter for moisture content and that the beads are not overheated causing damage. The microwave energy source 22 power output may also be adjusted by the microprocessor 70 to maintain a constant bead temperature. Additionally, other devices, such as valves or a non-passive cooling apparatus, may be conrolled by the microprocessor 70 in response to the above sensors or additional inputs.

In use, wet moisture laden gas enters the container 12 near the container bottom wall 30 outside of the processing shaft 42 through the wet gas source 16. The moisture absorbing ceramic beads 14 dry the gas by absorbing the moisture in the gas. The dry gas rises through the downwardly moving beads 14 to the dry gas outlet 20.

The beads 14 are guided toward the processing shaft 42 by the rounded container bottom wall 30. The beads 14 enter the processing shaft 42 through slots 46 in the bottom of the shaft 42 and are vertically transported by a feed screw 48 to the regeneration portion of the apparatus at the top of the shaft 42.

Microwave energy, as shown at arrow 24 in FIG. 1, generated by the microwave energy generator 22 at the top of the container 12 is directed down into the processing shaft 42 and heats the upwardly moving beads 14. The microwave energy 24 is dispersed within the shaft 42 by microwave absorbing ribbons 52 mounted on the non-energy absorbing vanes 50 of the feed screw 48. Insulation in the shaft 42 helps keep the heat inside the shaft 42.

As the beads 14 are heated, the absorbed moisture in the beads 14 is vaporized, drying the beads 14. The vaporized moisture is then drawn out of the container 12 through the suction port 26 at the top of the processing shaft 42 above the beads 14. When the beads 14 reach the top of the shaft 42, they spill out of the shaft 42 through slots 44 at the shaft 42 top and flow by gravity downwardly toward the container bottom wall 30 on the outside of the shaft 42 for reuse in the absorption portion of the apparatus 10.

Physical restrictions between the regeneration and moisture absorption portions of the apparatus 10 allow the movement of the beads 14 without appreciable loss of recirculating gas due to the gas flow snubbing resistance of the apparatus 10 which is substantially filled with beads 14.

The microprocessor 70 closed loop control senses temperature, humidity, microwave power, and screw rotation to optimize size and operating parameters for continuous moisture and absorbed gasses removal. This gives efficient regeneration and reuse in a more efficient and smaller package over commonly used batch/two box methods using conventional electrical resistance heat.

Although ceramic beads are disclosed as the absorption media for moisture, the apparatus as disclosed may use other materials such as ceramic powders, or plastic beads, and some paste compositions which intrinsically absorb and heat microwave energy and absorb elements other than moisture to cleanse a gas.

In addition, the apparatus and method described herein is a single stage embodiment. An alternative embodiment would be to connect drying apparatuses in series, each apparatus containing the same or a different absorption media to remove water or other contaminants from the gas. Other alternatives include inclined horizontal forms which can be bidirectionally tilted on a central pivot to accommodate regeneration and moisture drying use.

While there has been shown and described what are at present considered the preferred embodiment of the invention, it will be obvious to those skilled in the art that various changes and modifications can be made therein without departing from the scope of the invention defined by the appended claims.

I claim:

1. A continuous absorption media regenerating apparatus comprising:

a chamber having a top and a bottom;

a shaft having a top and a bottom disposed within said chamber, said shaft having an opening at said top and bottom;

a conveying mechanism disposed within said shaft;

a microwave heatable absorption media disposed within said chamber and said shaft;

a gas inlet for introducing gas into said chamber, said gas containing a contaminant;

a microwave energy source directing microwave energy into said shaft;

a gas outlet for extracting said gas from said chamber after said gas is exposed to said absorption media; and a port for extracting said released contaminants from said chamber;

wherein said media absorbs contaminants from said gas, said conveying mechanism conveying said media entering said shaft through said opening at the bottom of said shaft so that said media exits at said opening at the top of said shaft and returns to said bottom of said chamber, said media absorbing contaminants from said gas and said media is heated by said microwave energy releasing said contaminants from said absorption media.

2. A continuous absorption media regenerating apparatus as in claim 1, wherein said shaft is a tube.

3. A continuous absorption media regenerating apparatus as in claim 2, wherein said conveying mechanism is a feed screw having vanes.

4. A continuous absorption media regenerating apparatus as in claim 3, wherein said vanes have microwave scattering material mounted thereon.

5. A continuous absorption media regenerating apparatus as in claim 1, wherein said gas inlet is mounted proximate to said bottom of said chamber.

6. A continuous absorption media regenerating apparatus as in claim 1, wherein said gas outlet is mounted above said gas inlet.

7. A continuous absorption media regenerating apparatus as in claim 1, wherein said port is mounted above said shaft.

8. A continuous absorption media regenerating apparatus as in claim 1, wherein said port is a suction port.

9. A continuous absorption media regenerating apparatus as in claim 1, wherein said absorption media is microwave heatable ceramic beads.

10. A continuous absorption media regenerating apparatus as in claim 9, wherein said ceramic beads are hygroscopic.

11. A continuous absorption media regenerating apparatus as in claim 10, wherein said ceramic beads are calcium aluminum silicate zeolites.

12. A continuous absorption media regenerating apparatus as in claim 1, wherein said shaft is insulated.

13. A continuous absorption media regenerating apparatus as in claim 1 further comprising a heat removing mechanism operatively associated with said chamber, wherein heat is removed from said beads.

14. A continuous absorption media regenerating apparatus as in claim 1 further comprising a cover gas inlet for introducing a cover gas into said chamber, wherein said cover gas aids in the transport of said moisture out of said chamber.

15. A continuous absorption media regenerating apparatus as in claim 14 wherein said cover gas is liquid nitrogen vapor.

16. A continuous absorption media regenerating apparatus as in claim 1 wherein said conveying mechanism and said microwave energy source is operatively controlled by a microprocessor.

17. A continuous absorption media regenerating apparatus as in claim 1 wherein said apparatus is tiltable on a pivot.

18. A continuous absorption media regenerating apparatus comprising:

a chamber having a first end and a second end;

a microwave heatable absorption media disposed within said chamber;

a conveying mechanism disposed within said chamber and adapted to transport said media between said first and second ends;

a gas inlet for introducing gas into said chamber, said gas containing contaminants;

a microwave energy source directing microwave energy into said absorption media;

a gas outlet for extracting said gas from said chamber after said gas is exposed to said absorption media; and a port for extracting released contaminants from said chamber;

wherein said media absorbs contaminants from said gas, said conveying mechanism conveying said media for contact with said contaminants and said microwave energy, said media absorbing contaminants from said gas and said media is heated by said microwave energy releasing said contaminants from said absorption media.

* * * * *